US005904400A

United States Patent [19]

Wei

[11] Patent Number: 5,904,400

[45] Date of Patent: May 18, 1999

[54] ADJUSTABLE CHAIR

[76] Inventor: Hsien-I Wei, No. 208-1, Tachuwei, Hongchu Village, Luchu Hsiang, Taoyuan Hsien, Taiwan

[21] Appl. No.: 08/992,107

[22] Filed: Dec. 16, 1997

[51] Int. Cl.[6] ..... B60N 2/02

[52] U.S. Cl. ..... 297/353; 297/383; 297/361.1; 297/344.18; 297/284.1

[58] Field of Search ..... 297/353, 344.19, 297/383, 362.12, 362.13, 300.2, 337, 313, 325–328, 316, 411.37, 361.1, 284.1, 344.18

[56] References Cited

U.S. PATENT DOCUMENTS

| | | |
|---|---|---|
| 2,800,947 | 7/1957 | Thiem . |
| 3,711,054 | 1/1973 | Bauer . |
| 4,743,065 | 5/1988 | Meiller et al. . |
| 4,763,952 | 8/1988 | Gaudreau, Jr. . |
| 5,009,467 | 4/1991 | McCoy . |
| 5,035,466 | 7/1991 | Mathews et al. . |
| 5,048,893 | 9/1991 | Cowan et al. . |
| 5,405,189 | 4/1995 | Stumpf . |
| 5,439,267 | 8/1995 | Peterson et al. . |
| 5,577,804 | 11/1996 | Tedesco . |

FOREIGN PATENT DOCUMENTS

| | | |
|---|---|---|
| 3201052 | 7/1983 | Germany . |

*Primary Examiner*—Milton Nelson, Jr.
*Attorney, Agent, or Firm*—Kirkpatrick & Lockhart LLP

[57] ABSTRACT

An adjustable chair having a seatback combined with a cushion and a backcover, a seat combined with a pad and a pad casing, a pair of armrests mounted at two sides of the seat, a column bracket with casters supporting the seat, and an adjustment body received in the seat and the seatback. Because the adjustable chair has a height adjustment device, a seat forward-pitch adjustment device, a seat driven member, a seatback lateral adjustment device, a seatback backward-pitch adjustment device, a seatback height adjustment device, and a waist-supporter attitude adjustment device, the height, the inclination of the seat, the seatback, and the waist-supporter and also the pitch of the seatback are adjustable. The adjustable chair further has a pair of controlling members mounted at two sides of the seat and each has a plurality of buttons and cables connected to the adjustment body, such that the movement of the adjustment body is controlled.

9 Claims, 13 Drawing Sheets

ADJUSTABLE CHAIR

BACKGROUND OF THE INVENTION

1. Field of the Invention

The present invention relates to an adjustable chair, and more particularly to a chair of which the elevation of a seat and a seatback thereof can be adjusted, also, the forward-pitch of the seat, the backward-pitch of the seatback and the attitude of a waist-supporter of the chair are adjustable.

2. Description of Related Art

In daily life, chairs are used frequently. Therefore, commonly-found chairs are generally designed ergonomically to meet the needs of a user's comfort. As will be recognized, these chairs still have a drawback in that they can not be adapted for different users with different statures because these chairs typically have a fixed configuration. Furthermore, different users generally have different customs and preferences of seating. Therefore, there is a need for a chair which can be adjusted according to the user's requirements and preferences.

The present invention provides an adjustable chair to mitigate and/or obviate the aforementioned problems.

SUMMARY OF THE INVENTION

The main object of the present invention is to provide an adjustable chair of which the elevation of the seat and the seatback can be adjusted, also, the forward-pitch of the seat, the backward-pitch of the seatback and the attitude of the waist-supporter are adjustable.

In accordance with one aspect of the present invention, an adjustable chair comprises a seatback combined by a cushion and a backcover, a seat combined by a pad and a pad casing and provided for a person to be seated thereon, a pair of armrests mounted at two sides of the seat, a column bracket with casters supporting the seat, and an adjustment body received in the seat and the seatback. The adjustment body is composed of a first member, a second member and a third member pivotally interconnected to co-operably facilitate adjustment of the chair, wherein the adjustment of the chair is accomplished by a seat height adjustment means, a seat forward-pitch adjustment means, a seat driven member, a seatback lateral adjustment means, a seatback backward-pitch adjustment means, a seatback height adjustment means, and a waist-supporter attitude adjustment means. The adjustable chair further includes a pair of controlling members mounted at two sides of the seat for controlling the adjustment body. Each of the pair of controlling members has a plurality of buttons and cables connected to the adjustment body.

In accordance with another aspect of the present invention, the first member of the adjustment body has an upright tube extending integrally and downwardly therefrom and a pair of first lugs formed at two sides of a leading edge thereof. The second member of the adjustment body defines a front end and a back end. The front end of the second member has a pair of second lugs pivotably mounted at two side of a middle portion of the first member. The back end of the second member has a pair of slide rails mounted at two sides thereof and a connecting plate extending therefrom. The connecting plate has an elongate plate attachably mounted thereon to be received in the seatback. The third member of the adjustment body includes a board, a front plate extending forward from the board, and a pair of arms formed integrally and laterally on the front plate and pivotably engaged with the pair of first lugs of the first member.

Other objects, advantages and novel features of the invention will become more apparent from the following detailed description when taken in conjunction with the accompanying drawings.

DETAILED DESCRIPTION OF PREFERRED EMBODIMENT

Figure 1:
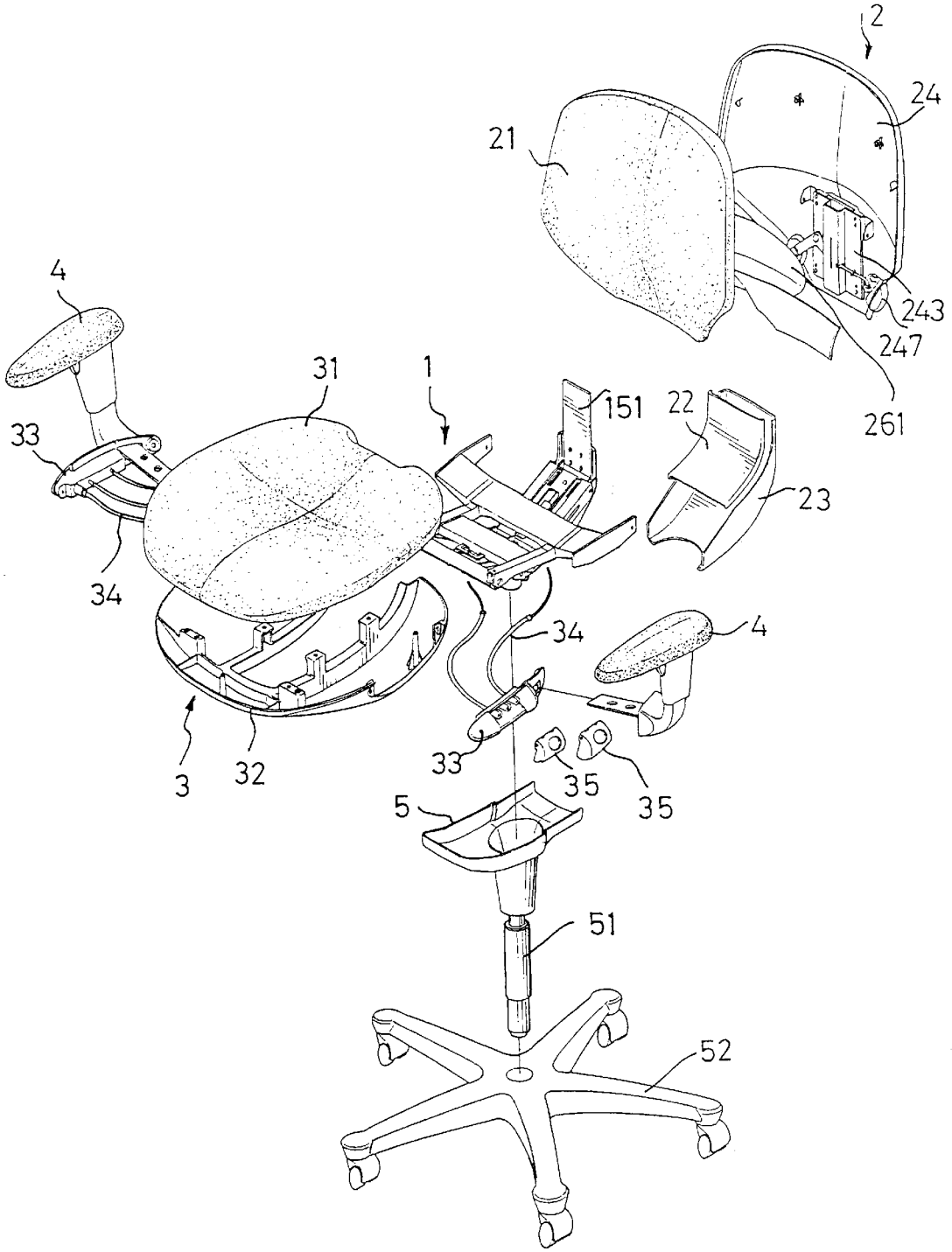
FIG. 1 is an exploded perspective view showing the elements of an adjustable chair in accordance with the present invention.

Referring initially to FIG. 1, an adjustable chair in accordance with the present invention substantially comprises an adjustment body 1, a seatback 2 combined with a cushion 21 and a backcover 24, a seat 3 including a pad 31 and a pad casing 32, a pair of armrests 4 mounted at two respective sides of the seat 3, and a column bracket 5 with casters 52. The adjustment body 1 is received in the seatback 2 and the seat 3 to provide different adjustment functions according to requirements. A pair of controlling members 33 is mounted at two respectively sides of the seat 2 for controlling the adjustment body 1 by a plurality of buttons 35 formed on each controlling member 33 and a plurality of cables 34 respectively connecting the buttons 35 with the adjustment body 1.

Figure 6:
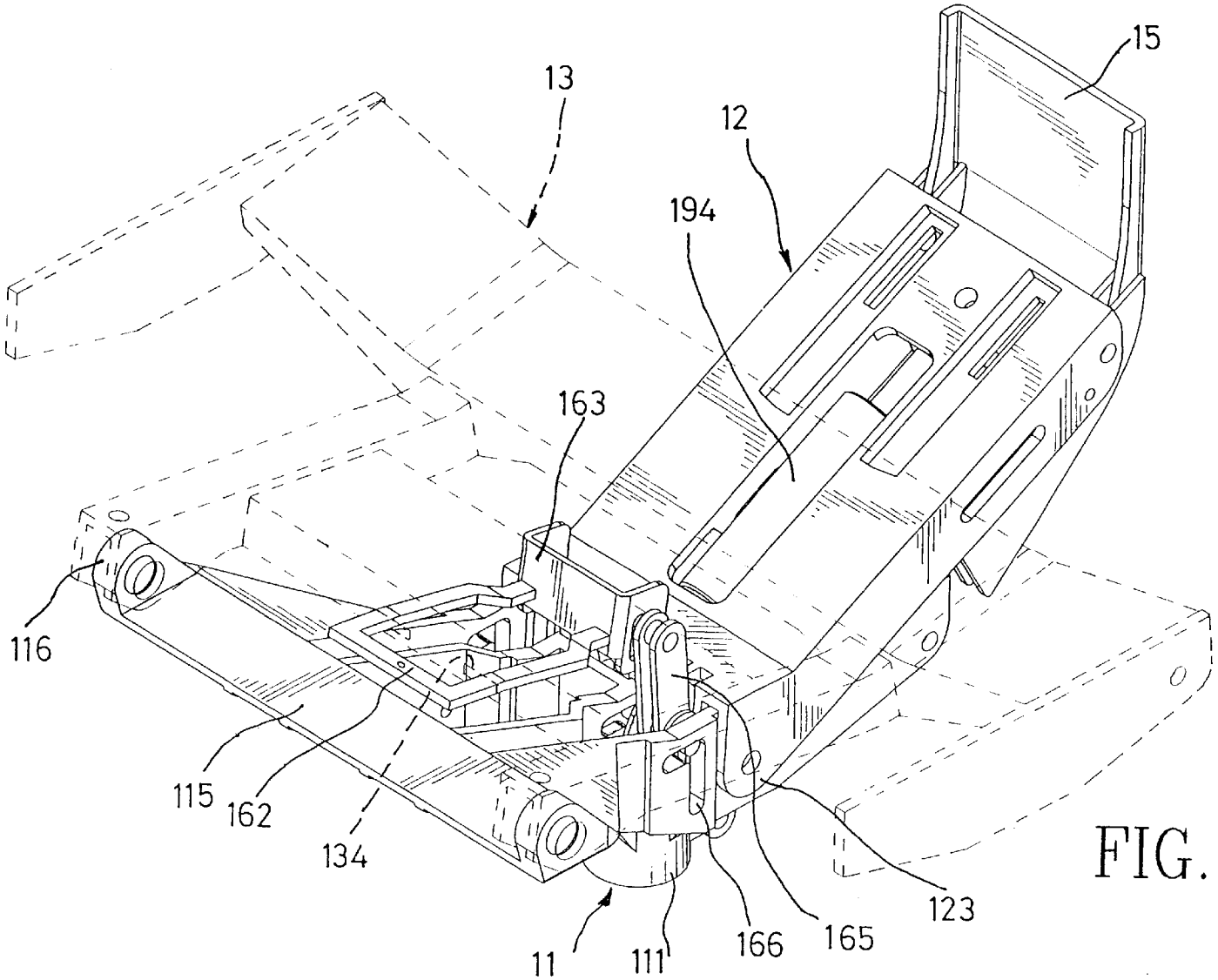
FIG. 6 is a schematic view showing an adjustment body of the adjustable chair in accordance with the present invention.
Figure 7:
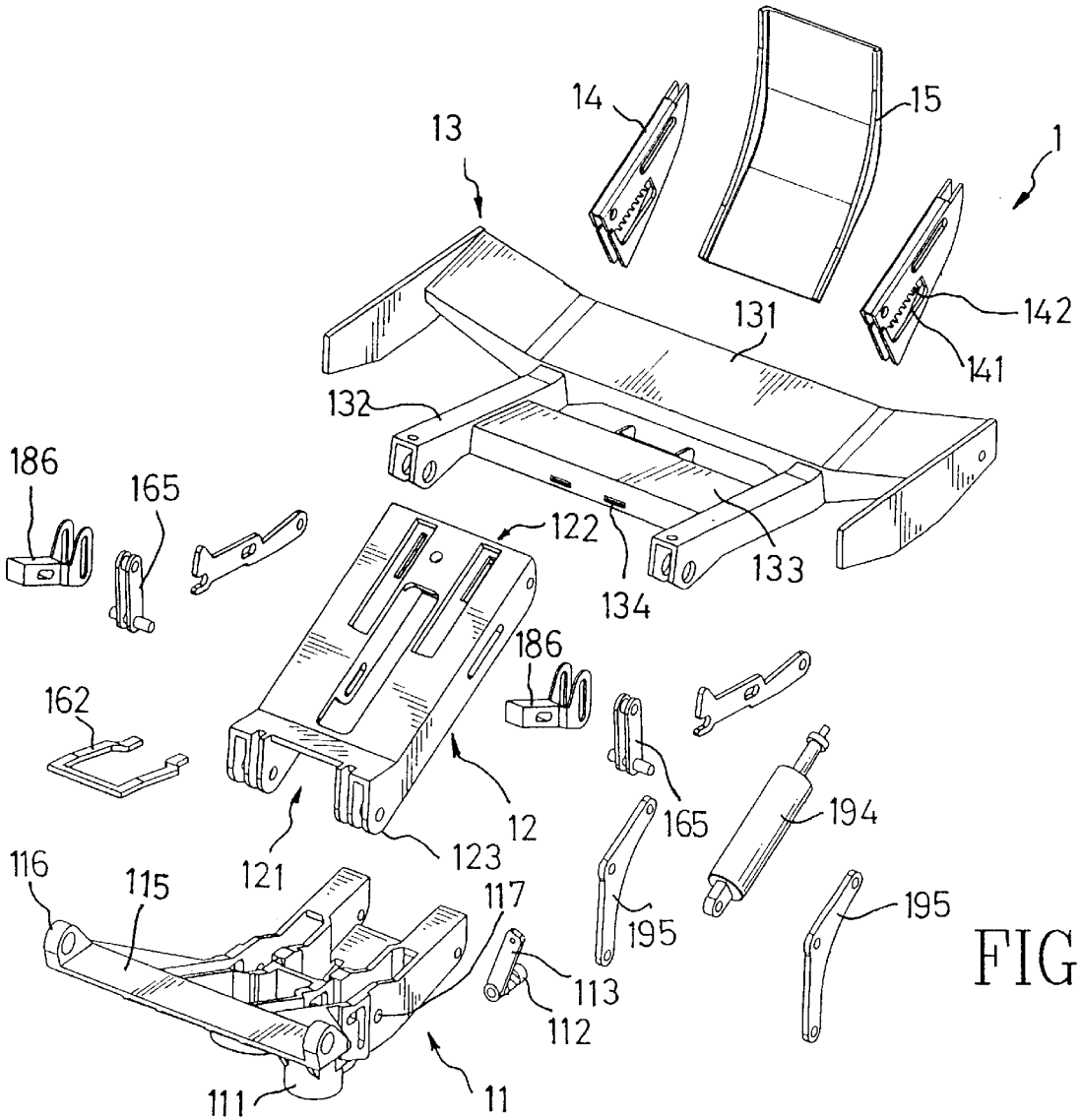
FIG. 7 is an exploded view of the adjustment body of the adjustable chair in accordance with the present invention.

Now referring to FIG. 1, FIG. 6 and FIG. 7, the adjustment body 1 is composed of a first member 11, a second member 12 and a third member 13 pivotally interconnected to co-operably facilitate adjustment of the chair. The first member 11 has an upright tube 111 extending integrally and downwardly therefrom and a pair of first lugs 116 formed at two respective sides of a leading edge 115 thereof. A middle portion (not numbered) of the first member 11 defines a pair of transverse holes 117 respectively at two sides thereof. The second member 12 has a front end 121 and a back end 122. The front end 121 of the second member 12 has a pair of second lugs 123 formed at two sides thereof so that a pair of pivots (not shown) can be extended through the respective one of the pair of second lugs 123 and a corresponding hole 117 to engage the second member 12 with the first member 11. The back end 122 of the second member 12 has a pair of slide rails 14 mounted at two sides thereof and a connecting plate 15 extending therefrom. The connecting plate 15 has an elongate plate 151 attachably mounted thereon to be received in the seatback 2. A front casing 22 and a rear casing 23 enclose the connecting plate 15 and the elongate plate 151 for decoration. The third member 13 includes a board 131. A front plate 133 extends forward from the board 131 and defines a pair of rectangular holes 134. A pair of arms 132 is formed integrally and respectively at two sides of the front plate 133 and is pivotably engaged with the pair of first lugs 116 of the first member 11.

As illustrated, the adjustable chair in accordance with the present invention provides a variety of adjustment functions by employing the adjustment body 1. These adjustment functions contain seat height adjustment, seat forward-pitch adjustment, seat driven adjustment, seatback lateral adjustment, seatback backward-pitch adjustment, seatback height adjustment and a waist-supporter attitude adjustment. All the above functions will be now described in detail as following in conjunction with accompanying drawings.

Figure 2:
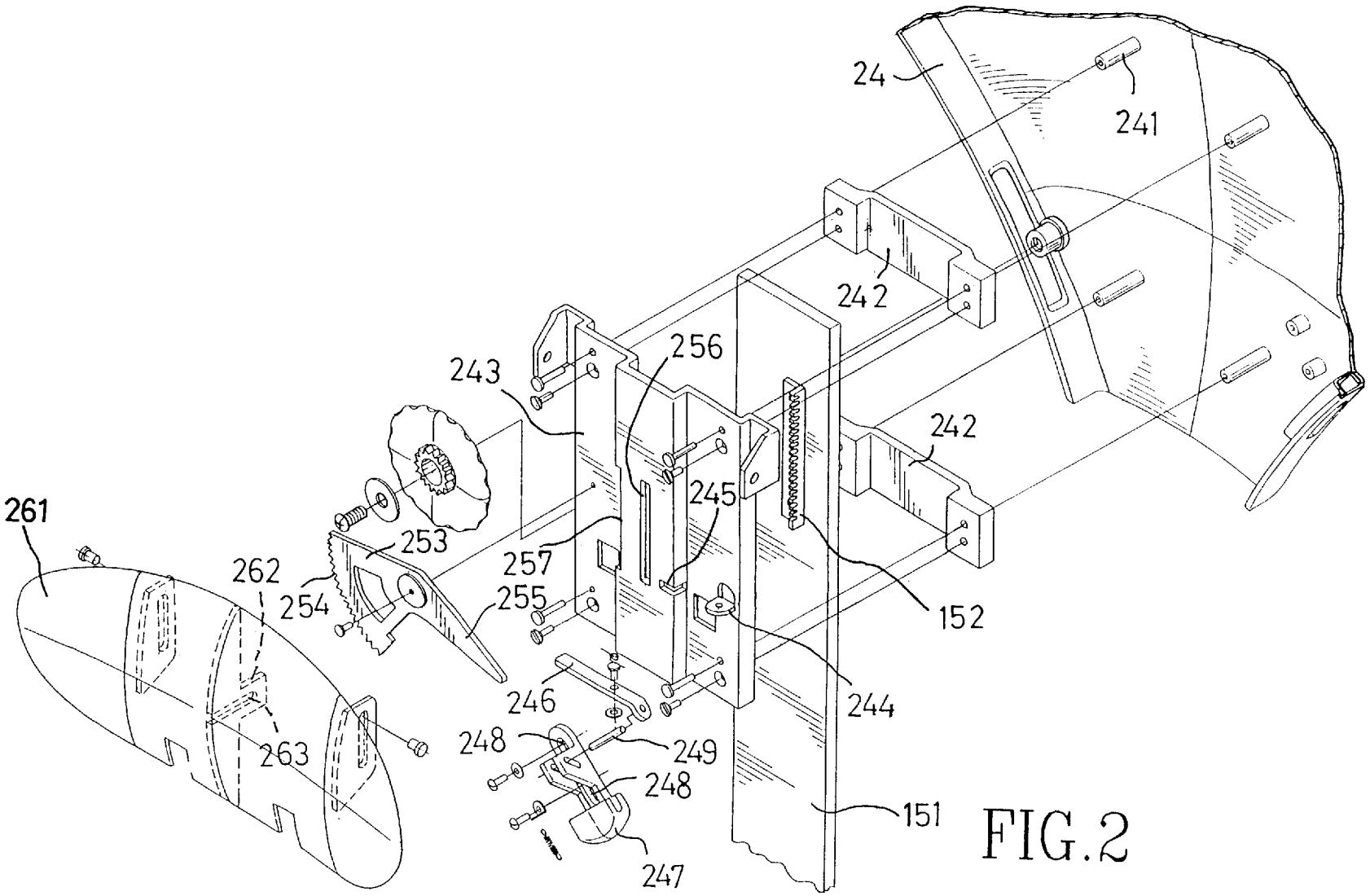
FIG. 2 is an exploded perspective view showing a seatback of the adjustable chair in accordance with the present invention.
Figure 4:
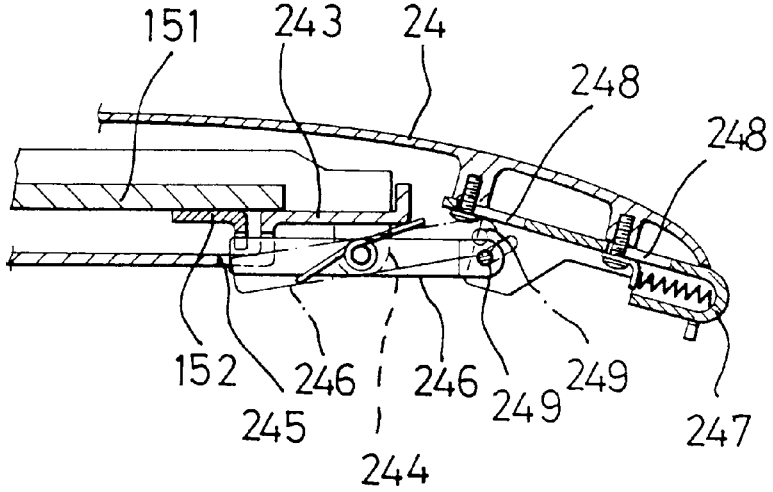
FIG. 4 is a partial longitudinal sectional view of the seatback, showing the seatback height adjustment means of the adjustable chair in accordance with the present invention.
Figure 3:
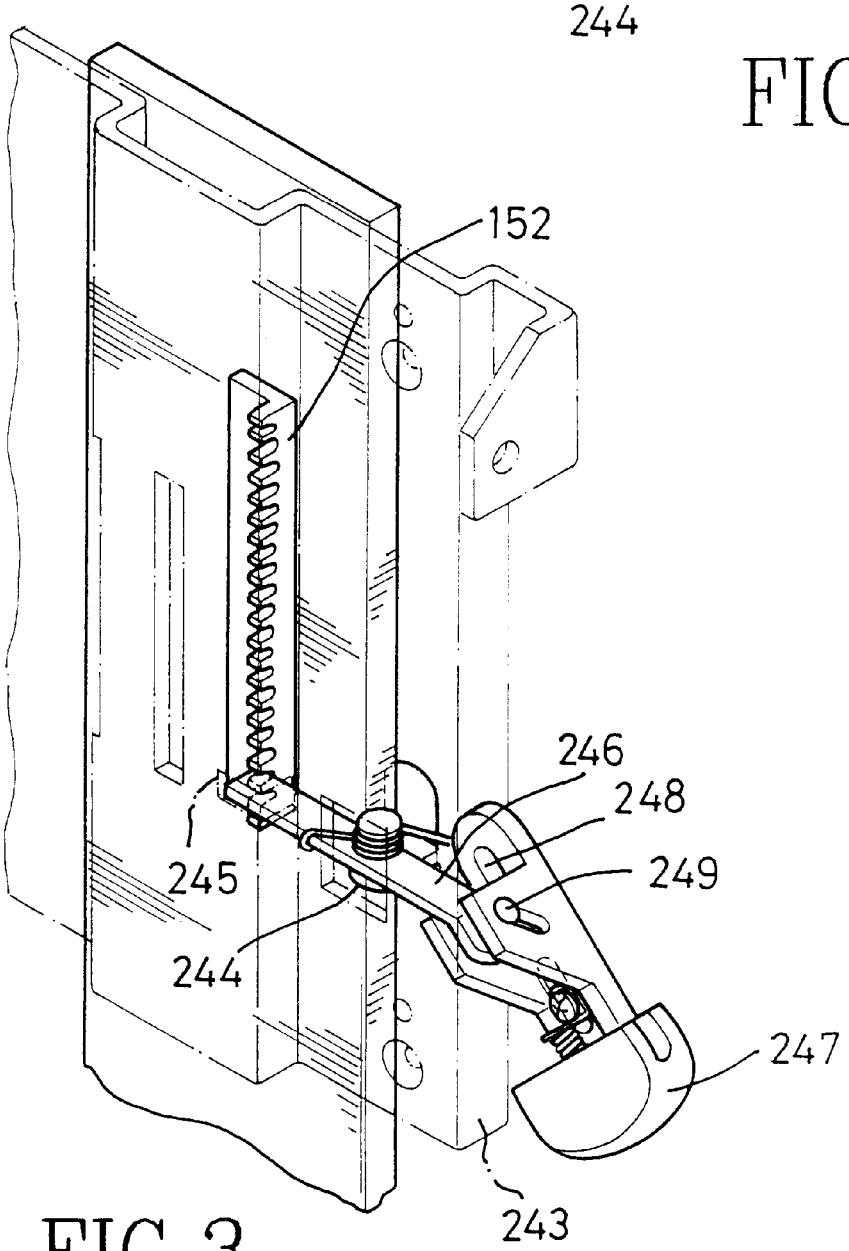
FIG. 3 is a partial enlargement view of the seatback, showing a seatback height adjustment means of the adjustable chair in accordance with the present invention.

Referring to FIGS. 1, 2, and 3, the backcover 24 of the seatback 2 has two pairs of posts 241 respectively extending from an upper portion and a lower portion thereof for two locating plates 242 to be mounted thereon. A middle casing 243 is also mounted on the two pairs of posts 241. The middle casing 243 is angled to define a first receptacle (not numbered) and a second receptacle in a center of the first receptacle. The second receptacle has a depth larger than that of the first receptacle. The first receptacle is provided for receiving the elongate plate 151 of the connecting plate 15. The second receptacle is designed to receive an L-shaped longitudinal rack bar 152 formed on a surface of the elongate plate 151 and the L-shaped rack bar 152 of the elongate plate 151 exactly abuts a first side of the second receptacle. The first receptacle has a tongue 244 integrally extending from an outer face thereof adjacent to the first side of the second receptacle for pivotably mounting a linked plate 246. The second receptacle further defines a notch 245 in the first side thereof aligning with one of a set of teeth of the L-shaped rack bar 152 so that a first end of the linked plate 246 can be extended therethrough and engaged with one tooth of the rack bar 152. A push button 247 is engaged with a second end of the linked plate 246 by a pivot 249. The push button 247 defines two slideways 248 in appropriate positions thereof for two bosses (not numbered) formed on the backcover 24 to be slidably and respectively received therein, whereby the movement of the push button 247 can be routed arcuately according to a circumference of the backcover 24. Referring to FIG. 4, when the height of the seatback 2 of the chair is to be adjusted, the push button 247 is urged to move in an arcuate route as illustrated. Therefore, the pivot 249 will drag the second end of the linked plate 246 obliquely and, in virtue of a torsional spring (not numbered) mounted on the linked plate 246, enable the first end of the linked plate 246 to be separated from the tooth of the L-shaped rack bar 152, whereby the seatback 2 is allowed to be elevated or lowered to a desired position. Thereafter, by releasing the push button 247, the first end of the linked plate 246 will re-extend through the notch 245 and is engaged with a different tooth of the rack bar 152 to secure the position of the seatback 2. In this way, the height adjustment of the seatback 2 can be attained.

Figure 5:
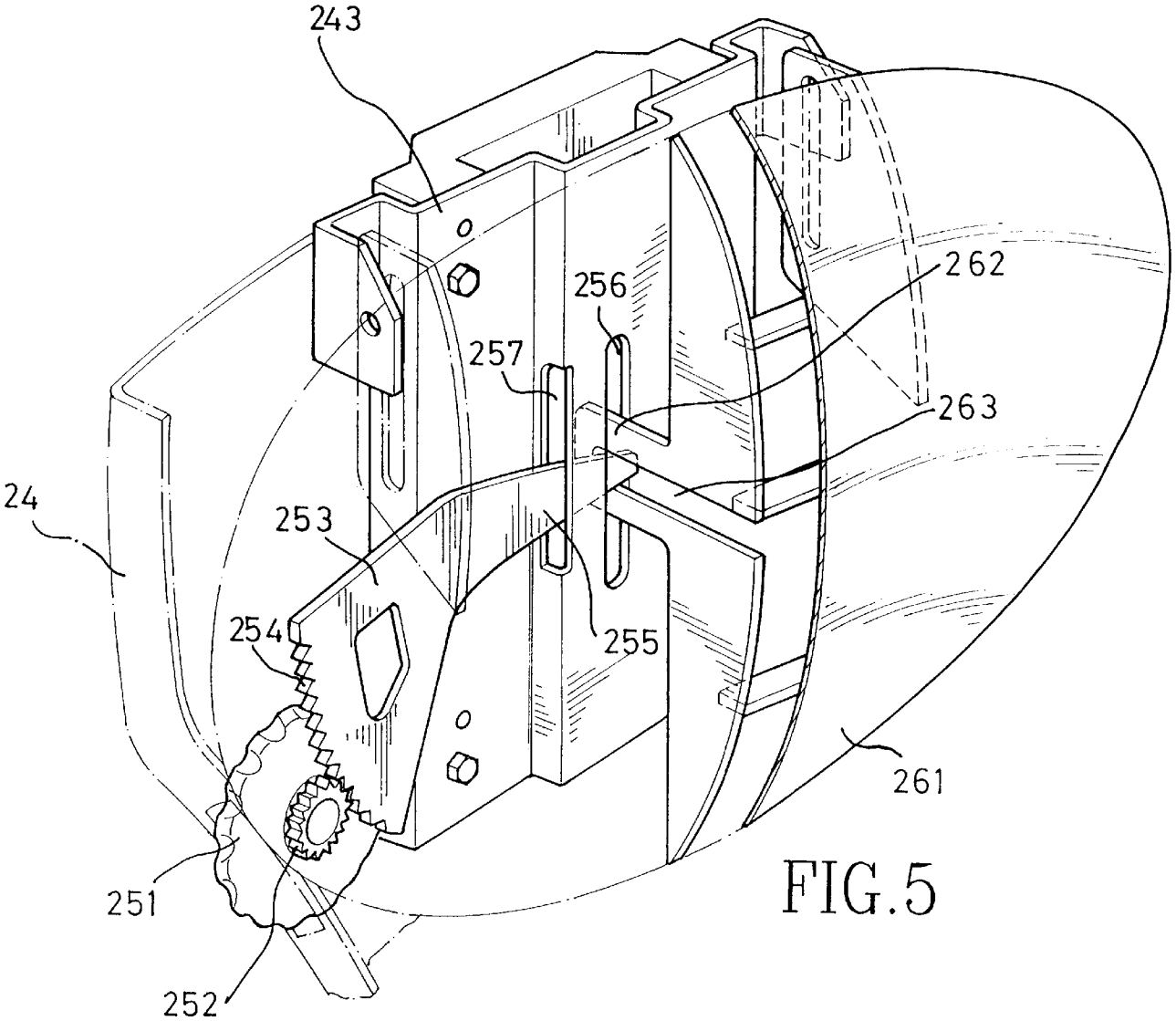
FIG. 5 is a schematic view showing a waist-supporter attitude adjustment means of the adjustable chair in accordance with the present invention.

Referring to FIG. 2 and FIG. 5, the second receptacle of the middle casing 243 defines a longitudinal slot 256 in a periphery thereof and defines a long hole 257 in a second side opposed to the first side thereof. A knob 251 with a gear 252 is rotatably mounted to the backcover 24 adjacent to the second side of the second receptacle. A part of the knob 251 slightly projects beyond the backcover 24 to facilitate operation. An inner pad 261 is disposed between the cushion 21 and the backcover 24 to function as a waist-supporter of the chair. The inner pad 261 has a mounting rib 262 extending therefrom to be inserted into the longitudinal slot 256 of the second receptacle of the middle casing 243. The mounting rib 262 defines a transverse slot 263 therein. An actuating plate 253 is used to drive the inner pad 261, thereby adjusting the attitude of the waist-supporter. The actuating plate 253 is configured as a flat bar and has a first end 254 with an arcuate toothed edge and a tapered second end 255. The arcuate toothed edge of the first end 254 is engaged with the gear 252 of the knob 251 and the tapered second end 255 is extended through the long hole 257 of the second receptacle and intersected into the transverse slot 263 of the mounting rib 262. With this arrangement, by operating the knob 251, the gear 252 will drive the actuating plate 253 and thus enable the mounting rib 262 of the inner pad 261 to move within the long hole 257 of the second receptacle. Therefore, a height adjustment of the waist-supporter of the chair can be obtained.

Figure 9:
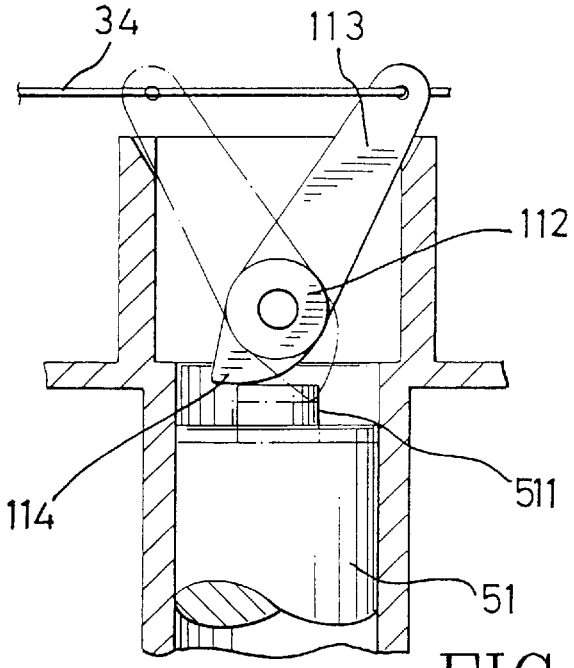
FIG. 9 is a sectional plan view showing the operation of the seat height adjustment means of the adjustable chair of FIG. 8.
Figure 8:
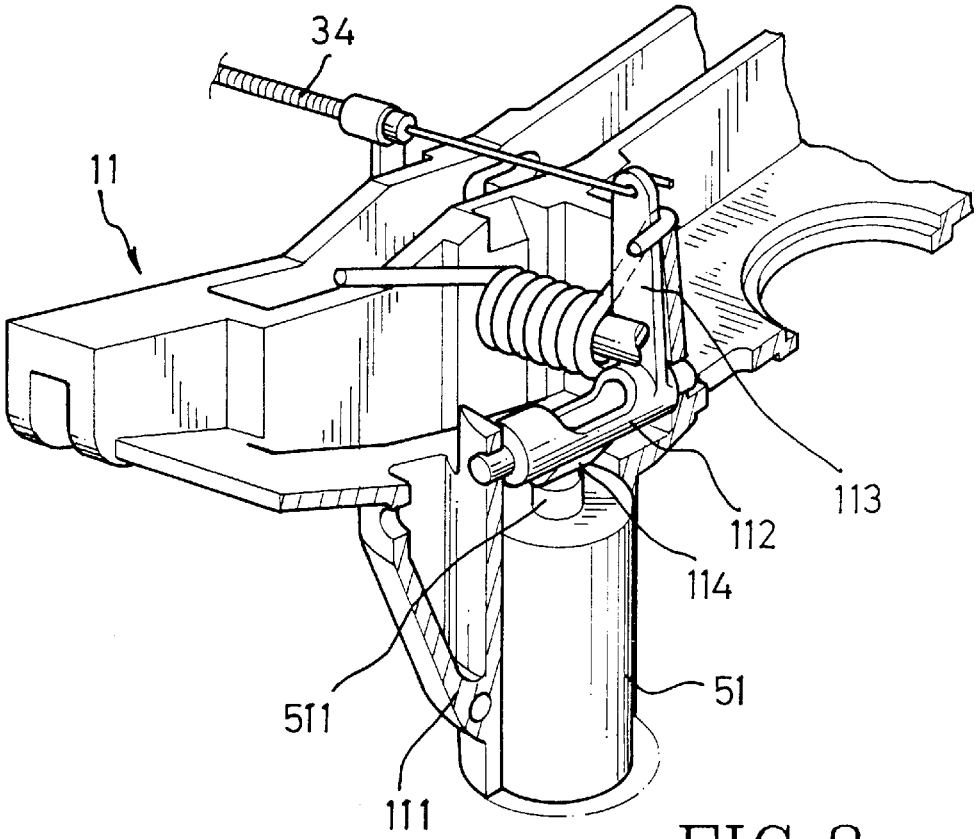
FIG. 8 is a partial enlargement view showing a seat height adjustment means of the adjustable chair in accordance with the present invention.

Referring to FIG. 8, the upright tube 111 of the first member 11 of the adjustment body 1 has a shaft 112 transversely disposed therein in a transverse direction. A protrusion 114 extends integrally and downwardly from the shaft 112 to be retained by a top block 511 formed on a stand bar 51 of the column bracket 5. A linkage 113 is integrally formed with the shaft 112 and is driven by one of the cables 34. Referring to FIG. 9, when a user operates a corresponding button 35 to pull the corresponding cable 34, the linkage 113 will be driven to pivot and press down the protrusion 114 of the shaft 12. As a result, the top block 511 of the stand bar 51 of the column bracket 5 will generate an upward reactive force to underprop the upright tube 111, thereby achieving a seat height adjustment.

Figure 11:
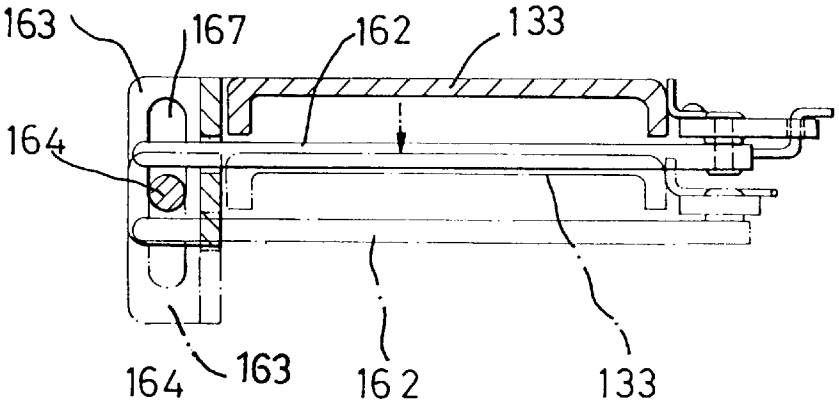
FIG. 11 is a sectional plan view showing the seat forward-pitch adjustment means of the adjustable chair of FIG.10.
Figure 10:
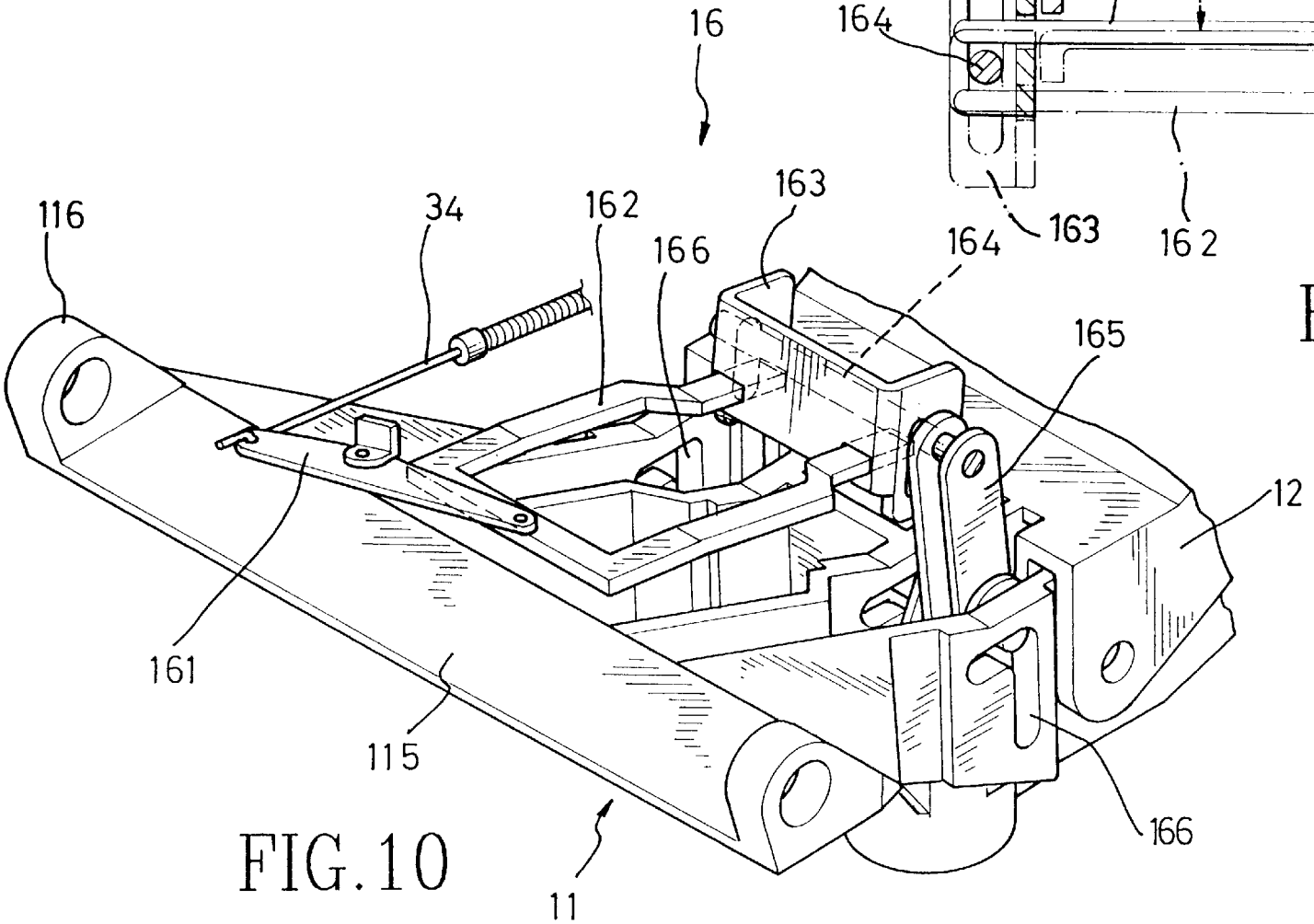
FIG. 10 is a partial perspective view showing a seat forward-pitch adjustment means of the adjustable chair in accordance with the present invention.

Referring to FIGS. 10 and 11, a seat forward-pitch adjustment means 16 is arranged within the adjustment body 1. The seat forward-pitch adjustment means 16 includes a pair of support arms 165 respectively received in two angled slots 166 respectively defined in two sidewalls of the middle portion of the first member 11. A block 163 is disposed between the pair of support arms 165. The block 163 has two side faces (not numbered) respectively attached to the pair of support arms 165 and defines a longitudinal slot 167 in each of the two side faces. A spindle 164 extends through the longitudinal slots 167 of the block 163 and is mounted between the pair of support arms 165. The seat forward-pitch adjustment means 16 further includes a U-shaped rack 162 mounted in a front of the block 163. With reference to FIG. 6, the U-shaped rack 162 has two distal ends in turn extending through the block 163 and the pair of rectangular holes 134 of the front plate 133 of the third member 13 to limit the movement of the front plate 133, as shown by the solid line in FIG. 11. In addition, a hinged arm 161 is pivotally mounted on the leading edge 115 of the first member 11 and has a first end pivotally connected to the U-shaped rack 162 and a second end driven by a corresponding cable 34. Referring to FIG. 11, when the user operates the corresponding cable 34 to pull the hinged arm 161, the U-shaped rack 162 will be driven to move toward the leading edge 115 of the first member 11 and release the limit to the front plate 133. At this time, the front plate 133 of the third member 13 is allowed to be pressed down, as shown by the arrow in the figure. Meanwhile, the block 163 is allowed to move downward within the longitudinal slots 167 until a periphery defining the longitudinal slots 167 is retained by the spindle 164. Thereafter, by releasing the cable 34, the U-shaped rack 162 will return to extend through the block 163 and the front plate 133, and is located below the spindle 164, as shown by the dashed lines in FIG. 11. In this way, the front plate 133 can move to a desired position and a forward-pitch adjustment of the of the seat will be achieved.

Figure 13:
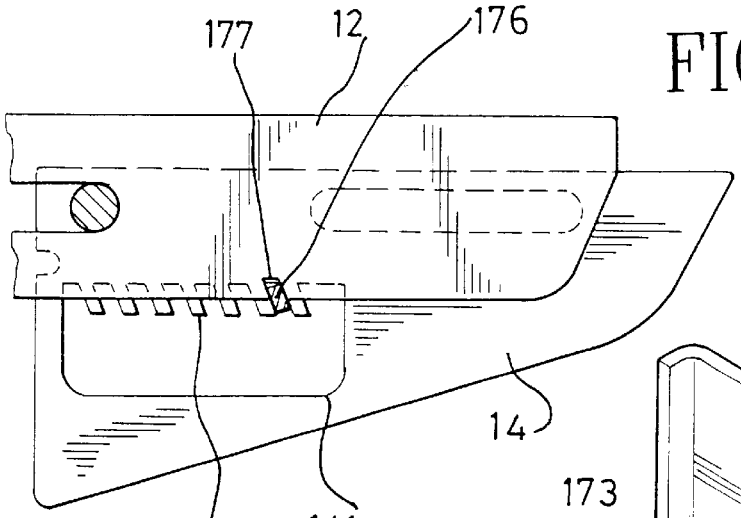
FIG. 13 is a plan view showing the seatback lateral adjustment means of the adjustable chair of FIG. 12.
Figure 12:
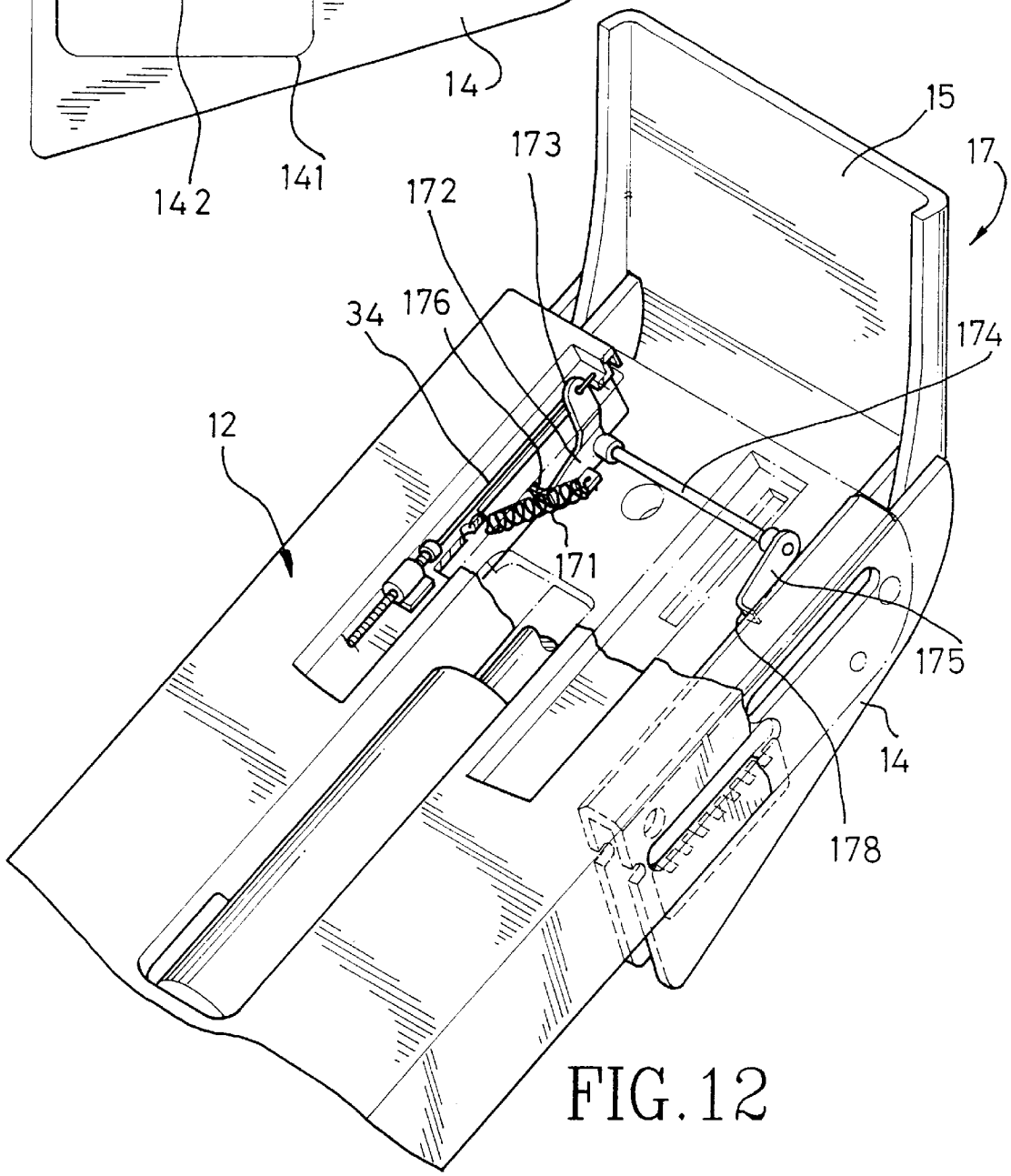
FIG. 12 is a partial perspective view showing a seatback lateral adjustment means of the adjustable chair in accordance with the present invention.

Referring to FIG. 12, a seatback lateral adjustment means 17 is arranged behind the second member 12 of the adjustment body 1. The seatback lateral adjustment means 17 includes a pin 174 disposed between two opposed sides of the pair of slide rails 14. The pin 174 has a first end (not numbered) connected to a driving member 172 and a second end (not numbered) connected to a driven member 175. The driving member 172 and the driven member 175 have respectively formed a hook 176 and 178 at an end thereof. Further, an extension plate 173 is formed on the driving member 172 and connected to the corresponding cable 34. Referring to,FIG. 7 and FIG. 13, the pair of slide rails 14 define a pair of rectangular slot 141 respectively in the two opposed sides thereof. Each rectangular slot 141 has formed a toothed edge 142 in a top periphery thereof. The second member 12 defines a pair of cutouts 177 respectively at a lower portion of two sides thereof corresponding to the toothed edge 142. In a normal state, the hooks 176 and 178 are received in a respective tooth of the toothed edges 142 of the slide rails 14 and the respective cutouts 177 of the second member 12. When the cable 34 is operated to pull the extension plate 173 of the driving member 172, the driving member 172 and the driven member 175 will be pivoted and the hooks 176 and 178 will be separated from the respective toothed edges 142 of the slide rails 14. Therefore, the slide rails 14 are permitted to move forward or backward along the second member 12. After the slide rails 14 are adjusted to a desired position, by releasing the cable 34, the hooks 176 and 178 will return to be received in a different tooth of the respective toothed edge 142 and the respective cutout 177, whereby a lateral movement adjustment of the seatback is attained.

Figure 14:
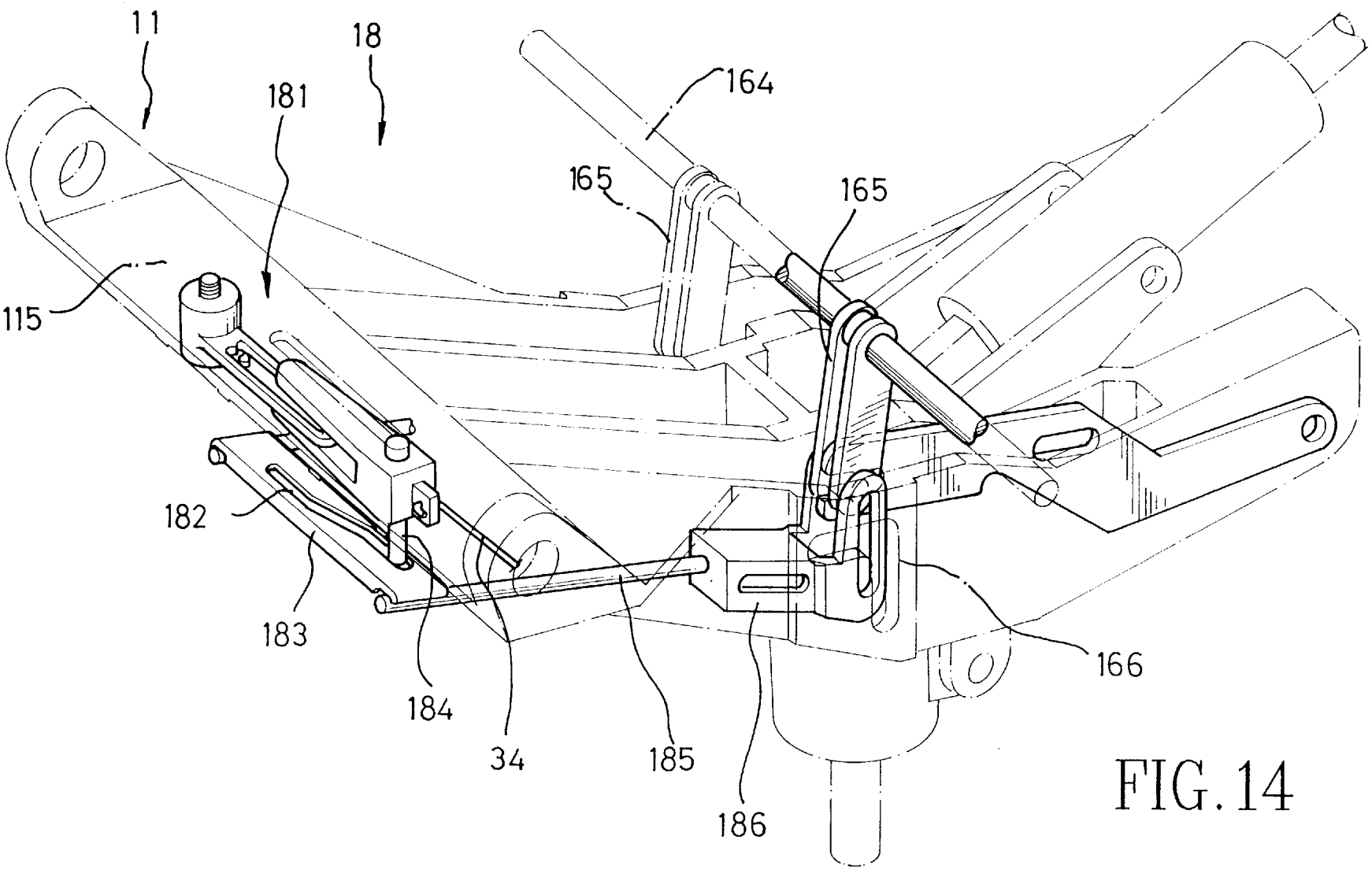
FIG. 14 is a schematic view showing a seat driven member of the adjustable chair in accordance with the present invention.
Figure 16:
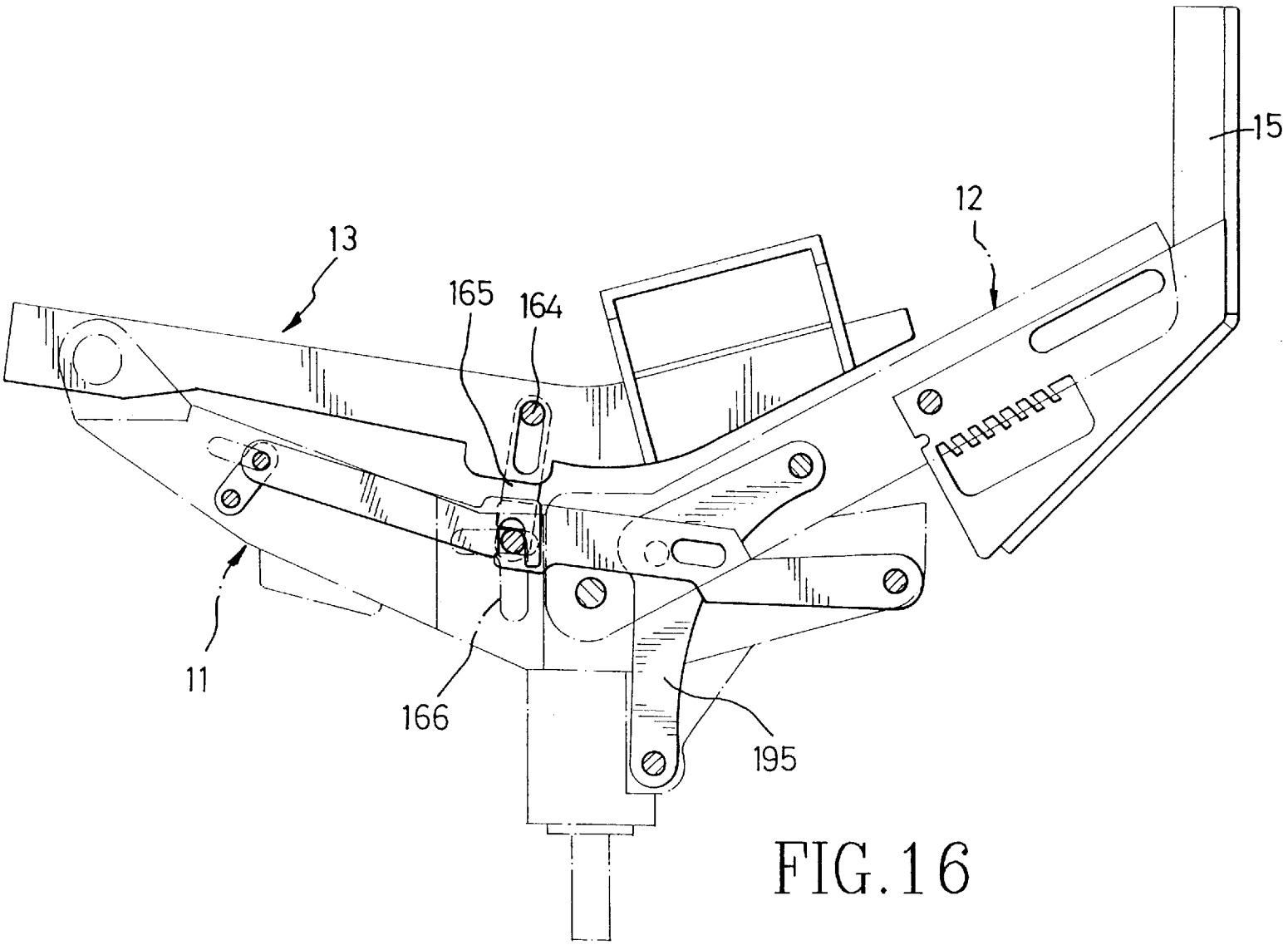
FIG. 16 is a first schematic view showing the operations of the seatback backward-pitch adjustment means and the seat driven member of the adjustable chair in accordance with the present invention.
Figure 17:
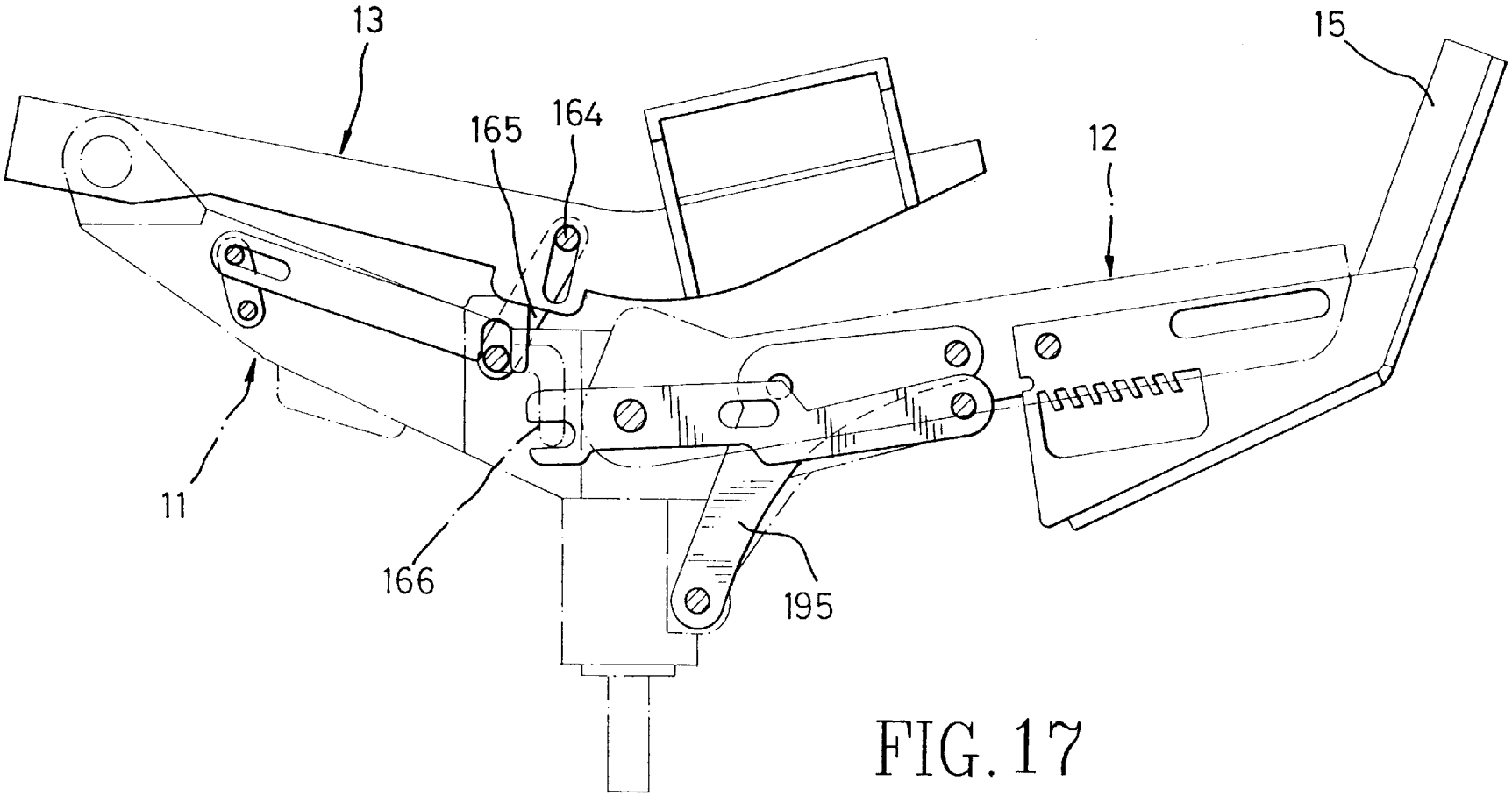
FIG. 17 is a second schematic view showing the operations of the seatback backward-pitch adjustment means and the seat driven member of the adjustable chair in accordance with the present invention.

Referring to FIG. 14, a seat driven member 18 is arranged below the leading edge 115 of the first member 11 of the adjustment body 1. The seat driven member 18 includes a drive unit 181 connected to a corresponding cable 34. A slide plate 183 defining a chute 182 is disposed under the drive unit 181. A drive rod 184 extends from the drive unit 181 and is movably received in the chute 182. A pair of link levers 185 respectively extend backward from two sides of the slide plate 183 and each lever 185 is connected to a link block 186. The link blocks 186 are respectively joined with the pair of support arms 165. When the respective cable 34 is pulled, the drive rod 184 of the drive unit 181 will be driven to move within the chute 182, thereby driving the slide plate 183 to move. As a result, the link levers 185 will drive the link blocks 186 and thus drive the pair of support arms 165 to move within the respective angled slots 166. With reference to FIG. 17, the pair of support arms 165 are located in a leftside of the angled slots 166 before the respective cable 34 is operated, as shown by dashed lines in the figure. With reference to FIG. 16, as the above mentioned, the support arms 165 will be driven to move in the angled slots 166 by operating the cable 34. When the support arms 165 respectively reach a rightside of the angled slot 166, they can be deflected and move toward the downmost position of the angled slots 166 by pressing down the front plate 133 of the third member 13. It is to be noted that a force for pressing down the front plate 133 is provided by the weight of the user seated on the seat 3, therefore the seat 3 can be driven as the third member 13 is driven.

Figure 15:
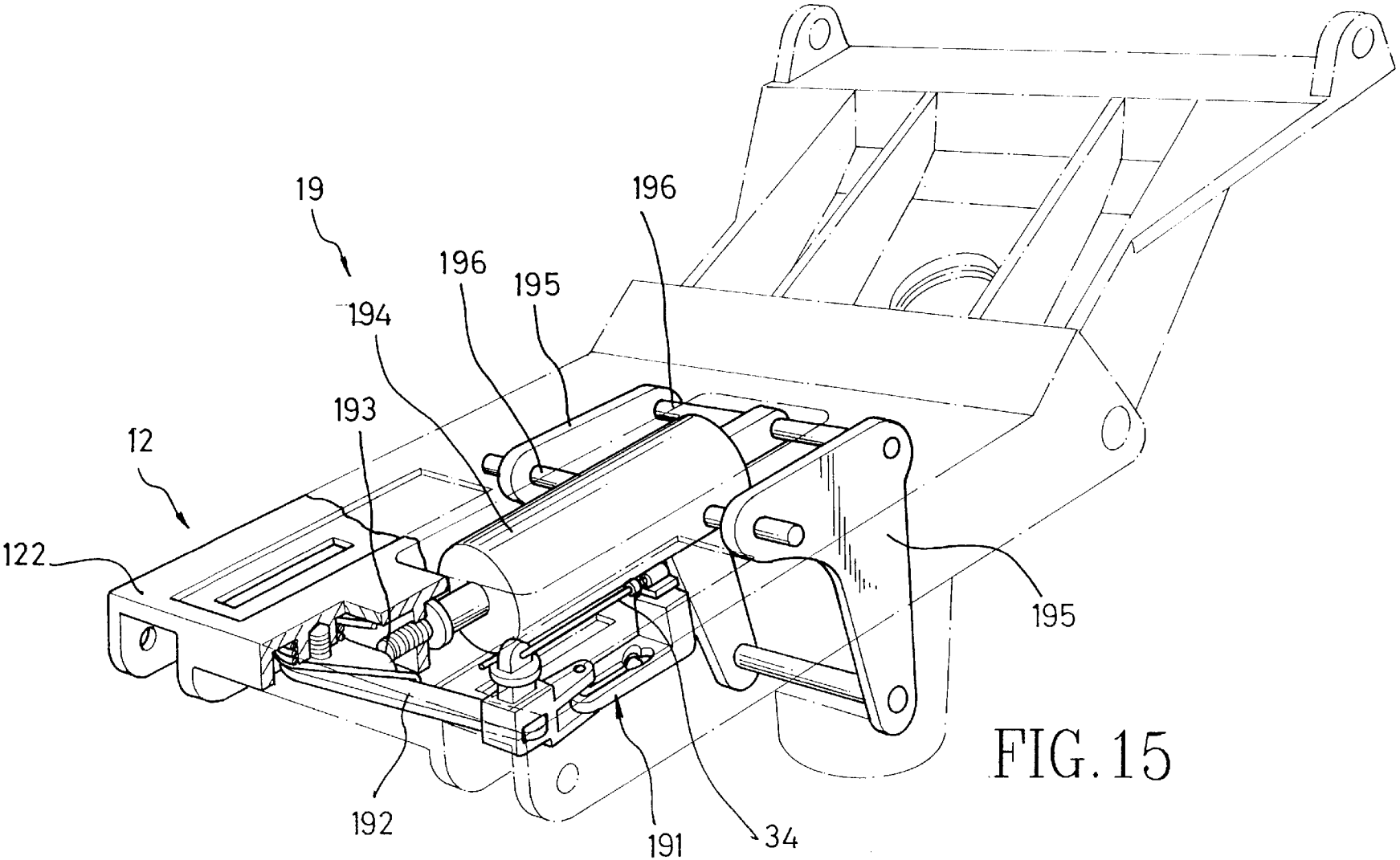
FIG. 15 is a schematic view showing a seatback backward-pitch adjustment means of the adjustable chair in accordance with the present invention.

Referring to FIG. 15, there is shown a seatback backward-pitch adjustment means 19 in accordance with the present invention. The seatback backward-pitch adjustment means 19 includes a junction plate 192 disposed at the back end 122 of the second member 12. A driving device 191 is connected with a first end of the junction plate 192 and driven by the corresponding cable 34. The junction plate 192 has a projecting plate 193 formed at an inside thereof and abutting a column 194. Two axles 196 respectively extend through a distal end and a middle portion of the column 194 in a transverse direction and are mounted between two opposed handrails 195 respectively fitted to two sides of the second member 12. With reference to FIG. 16, the connecting plate 15 received in the seatback 2 is in an upright state before the respective cable 34 is operated. With reference to FIG. 17, when the respective cable 34 is pulled by the user to drive the driving device 191, the junction plate 192 will be driven and the projecting plate 193 will urge the column 194, thereby enabling the two opposed handrails 195 to swing backward in virtue of the two axles 196. In this way, the connecting plate 15 is driven to swing backward by a desired angle. Therefore, a backward-pitch of the seatback 2 can be adjusted.

Accordingly, the present invention provides an adjustable chair which can adjust the height of the seat and the seatback, the forward-pitch of the seat, the backward-pitch of the seatback and the attitude of the waist-supporter. With the adjustable chair, different users can adjust the chair to a most comfortable and appropriate condition according to their preference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable chair comprising:

a seatback combined by a cushion and a backcover;

a seat combined by a pad and a pad casing and provided for a person to be seated thereon;

a pair of armrests mounted at two respective sides of the seat;

a column bracket with casters supporting said seat;

an adjustment body received in said seat and said seatback and composed of a first member, a second member and a third member pivotally interconnected to co-operably facilitate adjustment of the chair, wherein the adjustment of the chair is accomplished by a seat height adjustment means, a seat forward-pitch adjustment means, a seat driven member, a seatback lateral adjustment means, a seatback backward-pitch adjustment means, a seatback height adjustment means, and a waist-supporter attitude adjustment means; and a pair of controlling members mounted at two sides of the seat for controlling said adjustment body, each of said pair of controlling members having a plurality of buttons and cables connected to said adjustment body.

2. An adjustable chair as claimed in claim 1, wherein said first member has an upright tube extending integrally and downwardly therefrom and a pair of first lugs formed at two sides of a leading edge thereof, said second member defines a front end and a back end, said front end of the second member having a pair of second lugs pivotably mounted at two side of a middle portion of the first member, said back end of the second member having a pair of slide rails mounted at two sides thereof and a connecting plate extending therefrom, said connecting plate having an elongate plate attachably mounted thereon to be received in the seatback, said third member includes a board, a front plate extending forward from the board, and a pair of arms formed integrally and laterally on the front plate and pivotably engaged with the pair of first lugs of the first member.

3. An adjustable chair as claimed in claim 2, wherein said seat height adjustment means of the adjustment body is received in the upright tube of the first member and supported by the column bracket, said seat height adjustment means including:

a shaft transversely formed in the upright tube;

a protrusion extending integrally and downwardly from the shaft and being retained by a stand bar formed on the column bracket; and a linkage connected with the shaft and driven by one of the cables.

4. An adjustable chair as claimed in claim 2, wherein said seat forward-pitch adjustment means of the adjustment body includes:

a pair of support arms respectively received in two angled slots defined in two sidewalls of the middle portion of the first member;

a spindle extended through a block and mounted between the pair of support arms;

a U-shaped rack with two distal ends extending through the block and abutting the spindle; and a hinged arm pivotally coupled to the rack and driven by one of the cables.

5. An adjustable chair as claimed in claim 4, wherein said seat driven member of the adjustment body includes:

a drive unit driven by a corresponding cable;

a slide plate disposed under the drive unit and defining a chute;

a drive rod extending from the drive unit and movably received in the chute of the slide plate for driving the slide plate to move; and a pair of link levers respectively extending backward from two sides of the slide plate and connected to a link block, said link blocks being respectively joined with the pair of support arms for driving the support arms to move within the pair of angled slots of the seat forward-pitch adjustment means.

6. An adjustable chair as claimed in claim 2, wherein said seatback lateral adjustment means of the adjustment body includes:

a pin disposed between two opposed sides of the pair of slide rails; and a driving member connected with a first end of the pin and a driven member connected with a second end of the pin, said driving member and said driven member having respectively formed a hook at an end thereof to be selectively received in a toothed edge of a respective rectangular slot defined in the second member, said driving member further having an extension plate formed thereon and driven by a corresponding cable.

7. An adjustable chair as claimed in claim 6, wherein said seatback backward-pitch adjustment means of the adjustment body includes:

a junction plate disposed at the back end of the second member;

a driving device connected with the junction plate and driven by a corresponding cable;

a projecting plate extending from an inside of the junction plate and abutting a column; and two axles respectively extending through a distal end and a middle portion of the column in a transverse direction and being mounted between two opposed handrai Is, said two opposed handrails being provided for driving the connecting plate received in the seatback.

8. An adjustable chair as claimed in claim 2, wherein said seatback height adjustment means of the adjustment body includes:

a middle casing mounted to an inner face of the backcover of the seatback, said middle casing defining a first receptacle for receiving the elongate plate of the connecting plate and a second receptacle in a center of the first receptacle for receiving an L-shaped longitudinal rack bar formed on the elongate plate, said second receptacle having a depth larger than that of the first receptacle and defining a notch aligning with one of a set of teeth of the rack bar and a longitudinal slot therein;

a linked plate pivotably mounted on a tongue integrally extending from an outer face of the first receptacle, a first end of the linked plate extending through the notch of the first receptacle and engaging with the one tooth of the rack bar; and a push button engaged with a second end of the linked plate by a pivot, said push button defining two slideways in appropriate positions thereof for two bosses formed on the backcover to be slidably and respectively received therein, whereby the push button is operable to move in an arcuate routine according to a circumference of the backcover, said pivot being provided for dragging the second end of the linked plate obliquely during the movement of the push button and enabling the first end of the linked plate to be separated from the one tooth of the rack bar.

9. An adjustable chair as claimed in claim 8, wherein said waist-supporter attitude adjustment means of the adjustment body includes:

an inner pad disposed between the cushion and the backcover to function as a waist-supporter of the chair, said inner pad having a mounting rib extending therefrom to be inserted into the longitudinal slot of the second receptacle of the middle casing, said mounting rib defining a transverse slot therein;

a knob rotatably mounted to the backcover adjacent to a second side of the second receptacle, a part of the knob slightly projecting beyond the backcover to facilitate operation, said knob further having a gear mounted thereon; and an actuating plate configured to have a first end with an arcuate toothed edge and a tapered second end, said arcuate toothed edge engaging with the gear of the knob and the tapered second end extending through a long hole defined in the second receptacle and the transverse slot of the mounting rib for driving the inner pad.

* * * * *